US009656781B1

(12) United States Patent
Johnson et al.

(10) Patent No.: US 9,656,781 B1
(45) Date of Patent: May 23, 2017

(54) TRANSPORT STRUCTURE AND METHOD

(71) Applicant: Ebert Composites Corporation, Chula Vista, CA (US)

(72) Inventors: David W. Johnson, San Diego, CA (US); Scott A. Garrett, San Diego, CA (US); Stephen G. Moyers, Jamul, CA (US)

(73) Assignee: Ebert Composites Corporation, Chula Vista, CA (US)

( * ) Notice: Subject to any disclaimer, the term of this patent is extended or adjusted under 35 U.S.C. 154(b) by 0 days.

(21) Appl. No.: 15/087,824

(22) Filed: Mar. 31, 2016

Related U.S. Application Data

(60) Provisional application No. 62/145,374, filed on Apr. 9, 2015, provisional application No. 62/161,745, filed on May 14, 2015.

(51) Int. Cl.
*B65D 19/38* (2006.01)
*B65D 19/18* (2006.01)
*B65D 19/06* (2006.01)

(52) U.S. Cl.
CPC ..... *B65D 19/18* (2013.01); *B65D 19/06* (2013.01); *B65D 2519/00039* (2013.01); *B65D 2519/00074* (2013.01); *B65D 2519/00104* (2013.01); *B65D 2519/00109* (2013.01); *B65D 2519/00562* (2013.01); *B65D 2519/00572* (2013.01); *B65D 2519/00796* (2013.01)

(58) Field of Classification Search
CPC ..... B65D 2519/00019; B65D 2519/00034; B65D 2519/00044; B65D 2519/00054; B65D 2519/00079
USPC ..... 108/51.3, 57.25, 51.11
See application file for complete search history.

(56) References Cited

U.S. PATENT DOCUMENTS 2,432,295 A * 12/1947 Donahue ..... B65D 19/0012 108/51.3
3,273,518 A * 9/1966 Shina ..... B65D 19/0016 108/51.3
3,626,860 A * 12/1971 Blatt ..... B65D 19/0026 108/51.3
3,661,099 A * 5/1972 Shelor ..... B65D 19/0012 108/56.3
3,719,157 A * 3/1973 Arcocha ..... B65D 19/004 108/57.25
4,230,049 A * 10/1980 Horne ..... B29C 70/22 108/51.3
5,111,754 A * 5/1992 Adams, Jr. ..... B65D 19/0012 108/51.3
5,156,094 A * 10/1992 Johansson ..... B65D 19/0028 108/51.3
5,385,103 A * 1/1995 Juvik-Woods ..... B65D 19/0016 108/51.3
5,411,786 A * 5/1995 Kuo ..... B65D 19/0012 108/51.3
5,551,353 A * 9/1996 Fiedler ..... B29D 99/001 108/51.3

(Continued)

*Primary Examiner* — Jose V Chen
(74) *Attorney, Agent, or Firm* — Procopio Cory Hargreaves and Savitch LLP

(57) ABSTRACT

A 3D Z-axis fiber composite pallet, comprising a Z-axis reinforced sandwich panel including a bottom surface with a plurality of bolted-on and/or structurally bonded blocks that accommodate forks of a forklift there between, and a tough coating applied to surfaces of the 3D Z-axis fiber composite pallet.

20 Claims, 6 Drawing Sheets

(56) References Cited

U.S. PATENT DOCUMENTS

| | | | | | |
|---|---|---|---|---|---|
| 5,601,035 | A * | 2/1997 | Herring | B65D 19/0026 | 108/51.3 |
| 5,605,102 | A * | 2/1997 | Simpson | A47F 10/04 | 108/51.3 |
| 5,687,652 | A * | 11/1997 | Ruma | B65D 19/0012 | 108/57.25 |
| 6,676,785 | B2 * | 1/2004 | Johnson | B29C 70/086 | 156/166 |
| 6,745,703 | B2 * | 6/2004 | Torrey | B65D 19/0012 | 108/51.11 |
| 7,086,338 | B2 * | 8/2006 | Horiuchi | B65D 19/0012 | 108/51.3 |
| 8,146,516 | B2 * | 4/2012 | Linares | B32B 3/12 | 108/51.3 |
| 8,567,324 | B1 * | 10/2013 | Paradis | B65D 19/0012 | 108/51.3 |
| 2002/0002937 | A1 * | 1/2002 | Modesitt | B65D 19/0002 | 108/57.34 |
| 2002/0189507 | A1 * | 12/2002 | Benner | B65D 19/0012 | 108/51.3 |
| 2005/0229819 | A1 * | 10/2005 | Hollander | B65D 19/0026 | 108/51.3 |
| 2008/0196633 | A1 * | 8/2008 | Ho | B65D 19/0075 | 108/51.3 |
| 2010/0107933 | A1 * | 5/2010 | Love | B65D 19/0022 | 108/51.3 |
| 2011/0303128 | A1 * | 12/2011 | Linares | B65D 19/0012 | 108/51.3 |

* cited by examiner

TRANSPORT STRUCTURE AND METHOD

CROSS REFERENCE TO RELATED APPLICATIONS

This application claims the benefit of U.S. Provisional Patent Application Nos. 62/145,374, filed Apr. 9, 2015, and 62/161,745, filed May 14, 2015, which are incorporated by reference herein.

FIELD OF THE INVENTION

The present invention relates in general to pallets or skids, and, in particular to 3D Z-axis fiber composite pallet and composite pultrusion and process technology.

BACKGROUND OF THE INVENTION

Some of the problems with wooden pallets that are shipped from country to country by way of ocean, sea land containers include the passing of insects, pests, and fungi/molds.

SUMMARY OF THE INVENTION

An aspect of the invention involves a rugged pallet that can be used many times and is thus an ideal candidate for companies involved in the logistics of pallets, which can involve inventory, tracking and supplying customers with re-useable pallets. The rugged pallet ("pallet") is preferably a 3D Z-axis fiber insertion product and made through pultrusion. The pallet is preferably made of a material called TRANSONITE®, which is a registered trademark of Ebert Composites Corporation of Chula Vista, Calif. In one aspect of the invention, the pallet takes a Z-axis reinforced sandwich panel and, with a small amount of fabrication, removes core-material. Then a tough coating is applied to every surface, resulting in the creation of a very viable rugged, re-useable pallet.

Another aspect of the invention involves a 3D Z-axis fiber composite pallet comprising a Z-axis reinforced sandwich panel including a bottom surface with a plurality of bolted-on (and/or structurally bonded blocks that accommodate forks of a forklift there between, and a tough coating applied to surfaces of the 3D Z-axis fiber composite pallet.

A further aspect of the invention involves a pallet comprising a rectangular Z-axis fiber-reinforced composite sandwich panel including a bottom surface; and a plurality of blocks connect to the rectangular Z-axis fiber-reinforced composite sandwich panel along the bottom surface, the plurality of blocks spaced along the bottom surface to accommodate forks of a forklift there between.

One or more implementations of the aspect of the invention described immediately above includes one or more of the following: the pallet includes an outer surface and a tough coating applied to outer surface of the pallet; the rectangular Z-axis fiber-reinforced composite sandwich panel includes a fiber composite material including a first sandwich skin, a second sandwich skin, an interior core, and distinct groups of 3D Z-axis fibers that extend from the first sandwich skin to the second sandwich skin, linking the sandwich skins together; the plurality of blocks are bolted-on to the rectangular Z-axis fiber-reinforced composite sandwich panel along the bottom surface; the plurality of blocks are structurally bonded on to the rectangular Z-axis fiber-reinforced composite sandwich panel along the bottom surface; the rectangular Z-axis fiber-reinforced composite sandwich panel includes four corners and the plurality of blocks include corner blocks disposed at four corners of the rectangular Z-axis fiber-reinforced composite sandwich panel; the rectangular Z-axis fiber-reinforced composite sandwich panel includes opposite longitudinal ends with a center and the plurality of blocks include end blocks disposed at the center of the opposite longitudinal ends of the rectangular Z-axis fiber-reinforced composite sandwich panel; the rectangular Z-axis fiber-reinforced composite sandwich panel includes opposite lateral sides with a center and the plurality of blocks include side blocks disposed at the center of the opposite lateral sides of the rectangular Z-axis fiber-reinforced composite sandwich panel; the rectangular Z-axis fiber-reinforced composite sandwich panel includes a center and the plurality of blocks include a center block disposed at the center of the rectangular Z-axis fiber-reinforced composite sandwich panel; the first sandwich skin, the second sandwich skin, and the 3D Z-axis fibers are a thermoset composite material; the first sandwich skin, the second sandwich skin, and the 3D Z-axis fibers are a thermoplastic composite material; the interior core is a thermoset foam; the interior core is a thermoplastic foam; the plurality of blocks are composite pultrusions; the plurality of blocks are injection molded; at least one of structural adhesive and fasteners that connect the plurality of blocks along the bottom surface of the rectangular Z-axis fiber-reinforced composite sandwich panel; and/or the plurality of blocks include vertical edges with heavier wall thickness than other portions of the blocks.

Some of Applicant's patents in the general area of thermoset and thermoplastic technology are listed below and incorporated by reference herein:

| Patent Name | Pat. No. | Issue Date | Date Filed |
|---|---|---|---|
| Method of Inserting Z-Axis Reinforcing Fibers Into a Composite Laminate | 6,645,333 | Nov. 11, 2003 | Aug. 2, 2001 |
| Method of Clinching Top and Bottom Ends of Z-Axis Fibers into the Respective Top and Bottom Surfaces of a Composite Laminate | 6,676,785 | Jan. 13, 2004 | Nov. 19, 2001 |
| A Composite Laminate Structure | 7,217,453 | May 15, 2007 | Dec. 23, 2003 |
| Method of Inserting Z-Axis Reinforcing Fibers Into A Composite Laminate | 7,105,071 | Sep. 12, 2006 | Nov. 10, 2003 |
| 3D Fiber Elements With High Moment of Inertia Characteristics in Composite Sandwich Panels | 7,056,576 | Jun. 6, 2006 | Jun. 8, 2004 |
| Apparatus for Inserting Z-Axis Reinforcing Fibers Into a Composite Laminate | 7,387,147 | Jun. 17, 2008 | Sep. 11, 2006 |
| A Composite Laminate Structure | 7,846,528 | Dec. 7, 2010 | May 7, 2007 |
| Composite Sandwich Panel and Method of Making Same | 7,731,046 | Jun. 8, 2010 | Jul. 19, 2007 |
| Method of Inserting Z-Axis Reinforcing Fibers Into a Composite Laminate | 8,002,919 | Aug. 23, 2011 | Jun. 16, 2008 |
| A Composite Laminate Structure | 7,785,693 | Aug. 31, 2010 | Dec. 11, 2008 |
| Thermoplastic Pultrusion Die System and Method | 8,123,510 | Feb. 28, 2012 | Mar. 23, 2009 |
| A Composite Laminate Structure | 8,272,188 | Sep. 25, 2012 | Dec. 7, 2010 |
| Thermoplastic Pultrusion Die System and Method | 8,353,694 | Jan. 15, 2013 | Feb. 28, 2012 |
| Thermoplastic Pultrusion Die System and Method | 8,684,722 | Apr. 1, 2014 | Jan. 10, 2013 |

-continued

| Patent Name | Pat. No. | Issue Date | Date Filed |
|---|---|---|---|
| Thermoplastic Pultrusion Die System and Method | 8,747,098 | Jun. 10, 2014 | Oct. 9, 2013 |

BRIEF DESCRIPTION OF DRAWINGS

The accompanying drawings, which are incorporated in and form a part of this specification illustrate embodiments of the invention and together with the description, serve to explain the principles of the invention.

DESCRIPTION OF EMBODIMENTS OF THE INVENTION

With reference to FIGS. 1A to 2B, an embodiment of a rugged pallet 10 will be described. The pallet 10 is made from a sandwich panel such as panel 12 shown in FIG. 9. The sandwich panel 12 is 4 to −5 inches thick, although clearly it could be less than 4 inches thick for lighter load applications. Nominally, skins 131, 133 are composite X-Y material, which could be thermoset composite material or thermoplastic composite material and core 135 is a light-weight foam such as thermoset polyisocyanurate foam or thermoplastic PET foam. Important to the pallet 10 is the use of sandwich panel shown and described with respect to FIG. 9 below and related technology, which is described in more detail in U.S. Pat. Nos. 6,645,333 and 6,676,785, which are incorporated by reference herein. The 3D Z-axis insertion process shown and described with respect to U.S. Pat. Nos. 6,645,333 and 6,676,785 ties the skins 131, 133 to the core 135, preventing delamination, and additionally provides significant through-thickness compression strength to the core 135.

Figure 1A:
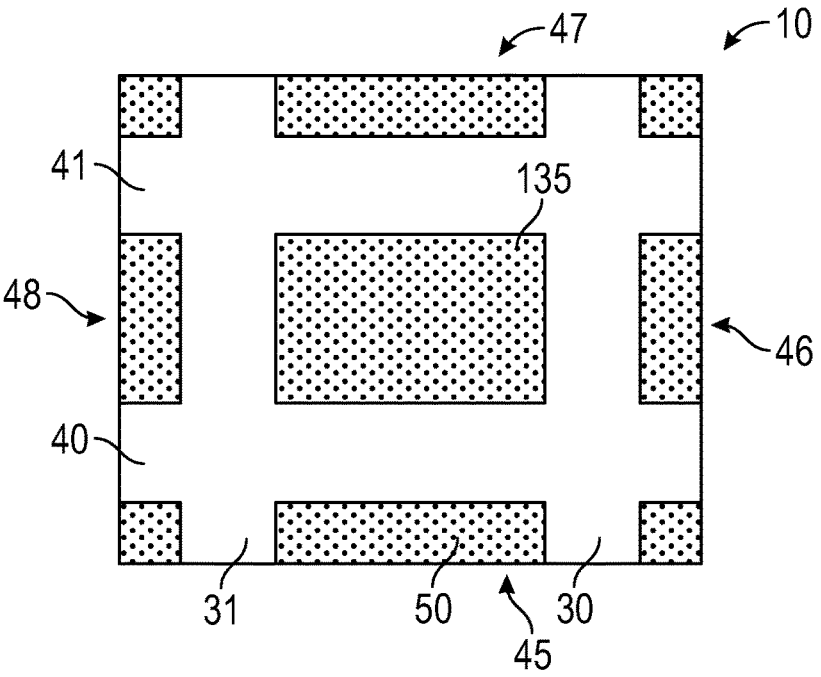
FIG. 1A is a cross-sectional view of an embodiment of a pallet through the middle or core section.
Figure 1B:
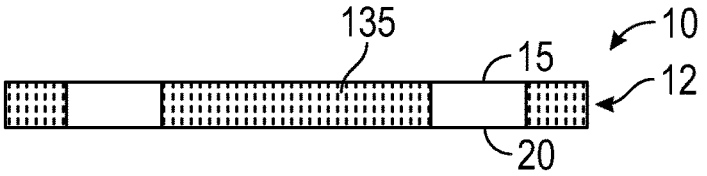
FIG. 1B is a rear elevational view of the pallet, the front elevational view being a mirror image thereof.
Figure 1C:
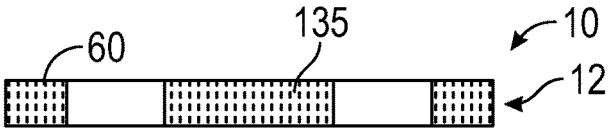
FIG. 1C is a right side elevational view of the pallet, the left side elevational view being a mirror image thereof.
Figure 2A:
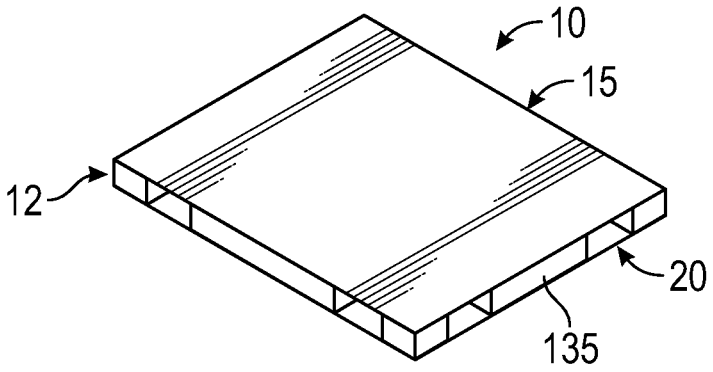
FIG. 2A is a perspective elevational view of the pallet.
Figure 2B:
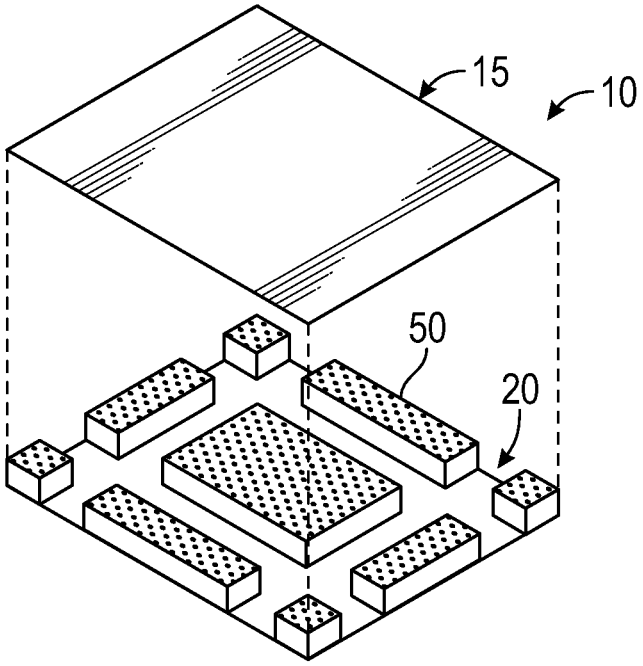
FIG. 2B is an exploded perspective elevational view of the pallet.
Figure 3:
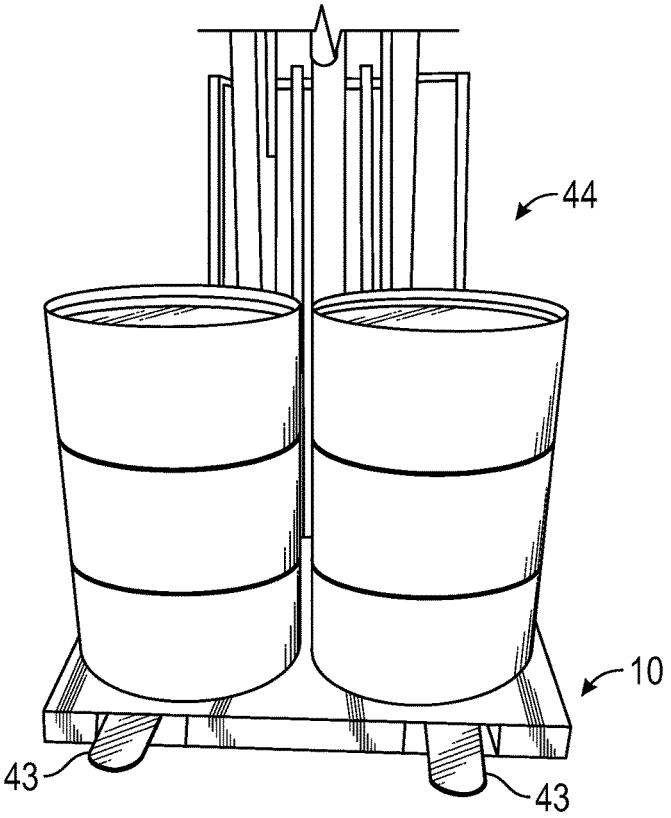
FIG. 3 is a perspective view of the pallet of FIGS. 1A-3 supporting two cylindrical containers and shows the two forks of a forklift inserted through a middle section of the pallet to support and transport the pallet and load.
Figure 4:
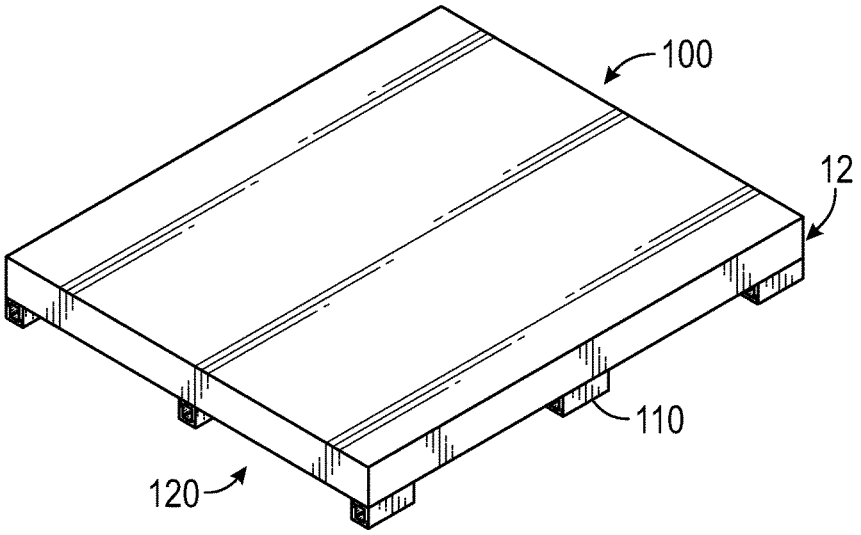
FIG. 4 is perspective view of an alternative embodiment of a pallet.
Figure 5A:
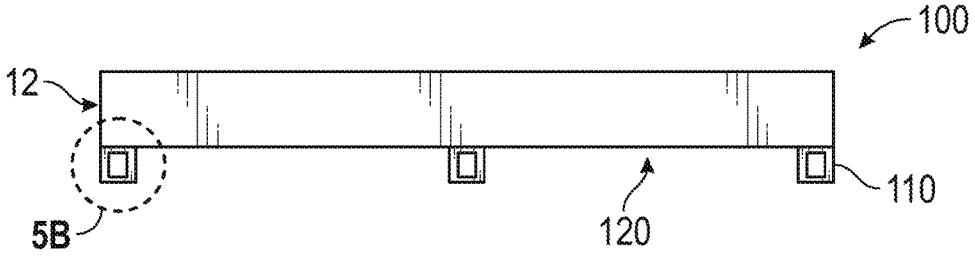
FIG. 5A is a front elevational view of the pallet of FIG. 4, the rear elevational view being a mirror image thereof.
Figure 5B:
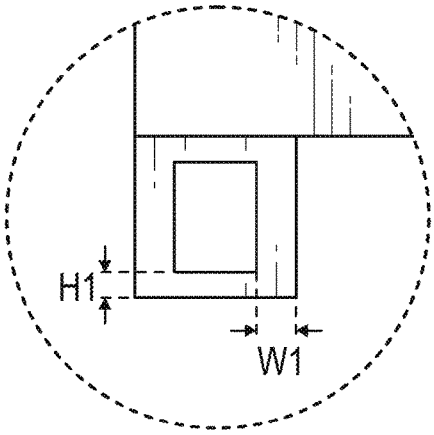
FIG. 5B is an enlarged view of section 5B shown in FIG. 5A.
Figure 6:
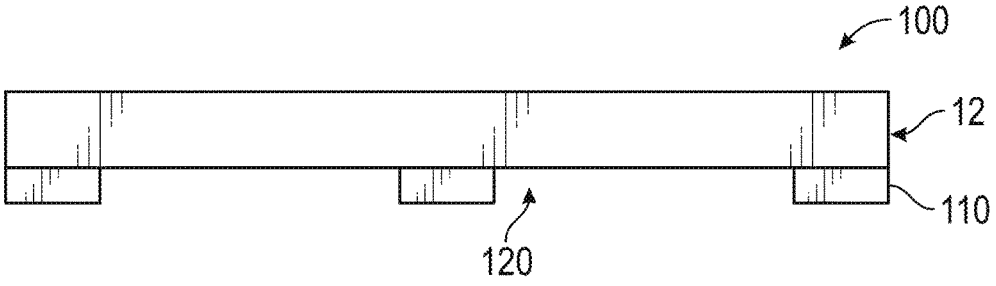
FIG. 6 is a left side elevational view of the pallet of FIG. 4, the right side elevational view being a mirror image thereof.
Figure 7:
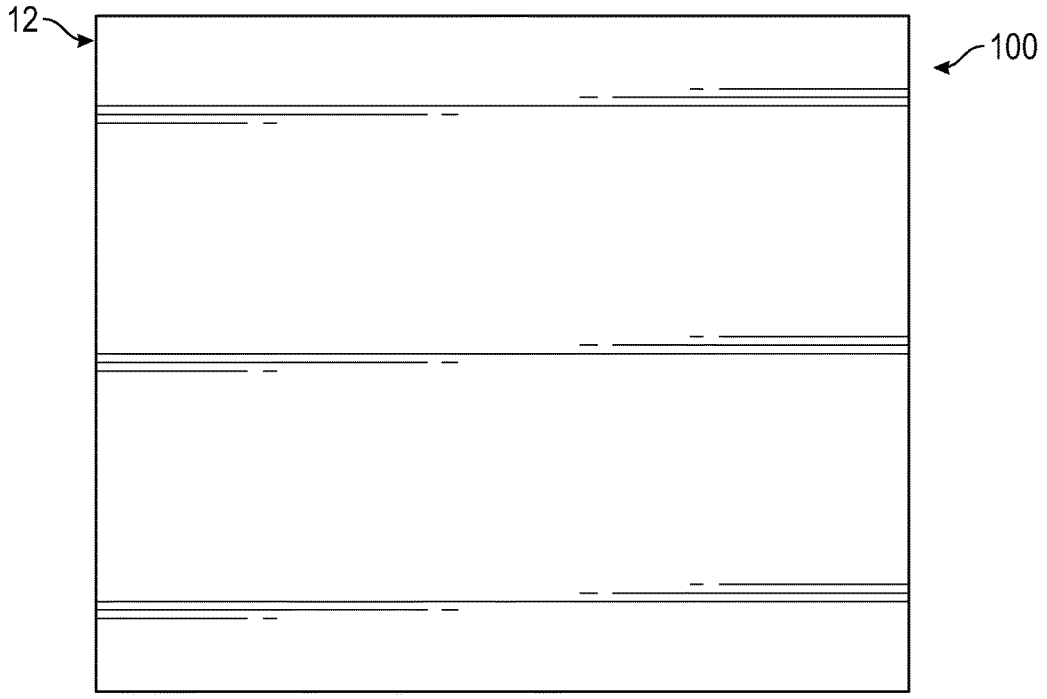
FIG. 7 is a top plan view of the pallet of FIG. 4.

Three views of the pallet 10 are shown in FIGS. 1A, 1B, and 1C. The isometric view shown in FIGS. 2A and 2B show a rendering of the completed pallet 10. Looking at the sum total of the figures, one can see portions of the core 135 have been removed. The voids 30, 31, 40, 41 are areas where the entire core 135 is removed. This allows forks 43 (FIG. 3) from a forklift 44 to be able to access the pallet 10 from any of four sides 45, 46, 47, 48.

Figure 9:
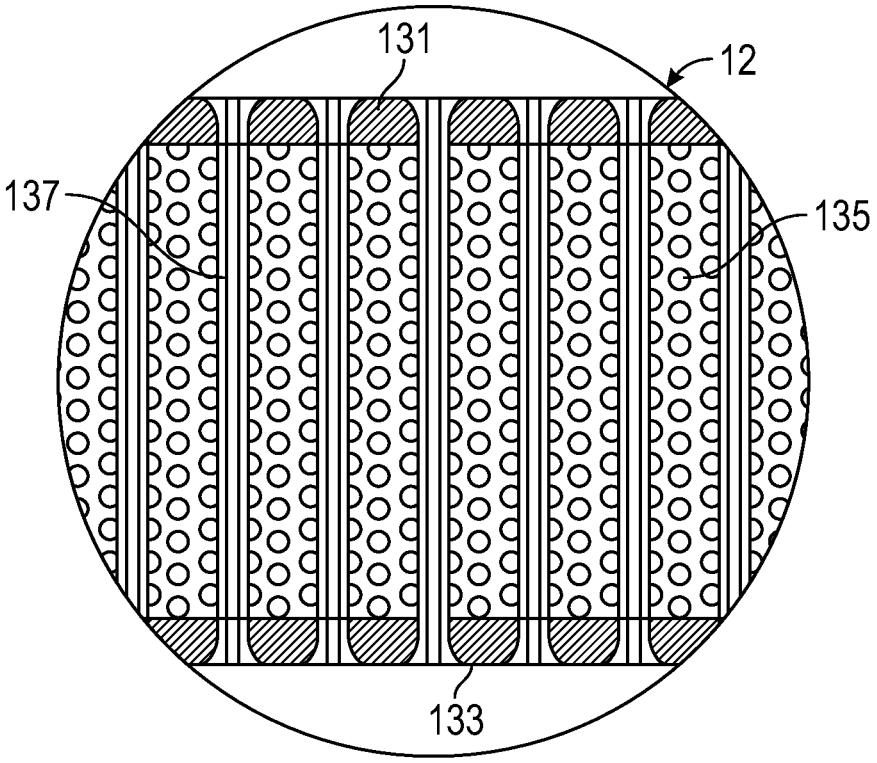
FIG. 9 is a cross-sectional view of an embodiment of a structural sandwich panel or part of the pallet of FIGS. 1A-3 and the pallet of FIGS. 4-9.

Note in FIG. 1C that 60 represents a multitude of 3D Z-axis fiber bundles 137, which are shown in more detail in FIG. 9. In the embodiment of the pallet 10 shown in FIG. 10, the 3D Z-axis fiber bundles 137 are at a density of one insertion per square inch. Because insertion of the 3D Z-axis fiber bundles 137 is robotic, these insertion densities can be programmed for any areal density Note in FIGS. 1B, 1C that 15 represents top skin 131 and 20 represents bottom skin 133, which are shown in more detail in FIG. 9. The skins 131, 133 are X-Y material as mentioned and may be as thick as 0.150 inches, which has been successfully tested in the past. The voids 30, 31, 40, 41 are created by removing foam from the sandwich panel 12. The sandwich panel 12 is pultruded with a complete core 135. However, the robotic 3D Z-axis insertion process can be programmed to only insert 3D Z-axis fiber bundles 137 through the sandwich panel 12 in the solid areas 50, as shown by FIG. 1*a*. U.S. Pat. No. 7,056,576, which is incorporated by reference herein, illustrates how the insertion process can be programmed to only insert 3D Z-axis fibers through the sandwich panel in certain areas. After pultrusion, the pultruded lineal is cut to sections that are approximately 48 inches by 40 inches, the foam core that is not inserted with 3D Z-axis fibers is removed (e.g., after the panel is cut to 48×40 inches, a ram plunger pushes the foam from one edge to opposite side). It can be removed easily as it will have a tendency to delaminate, having no 3D Z-axis fibers in said section.

In another process for forming voids 30, 31, 40, 41, a floating mandrel can be used to create a hollow section 30, 31 such that foam would not have to be removed to create the voids 30, 31. In this case, only the foam section defining voids 40, 41 in the Y-axis direction (90 degrees to the pultrusion direction) are removed with a special automatic ram-cutting device. Alternately, a re-useable core could be placed in a core-kit prior to pultrusion and then these re-useable "core-sections" could be used time and time again eliminating any waste stream.

Once the voids 30, 31, 40, 41 have been created, the entire pallet 10 can be coated with a tough poly-urea, epoxy, or urethane coating, or the like. This can be applied automatically by being either dipped or sprayed.

In this way, only 3 manufacturing operations are required to make the new pallet, all of which can be automated. There are no fasteners used and no assembly required. The three steps are:

(i) pultrusion of the sandwich panel 12 with only selected 3D Z-axis insertions in only the core material 135 that is to be remaining with the pallet 10, and (ii) removal of foam core material to allow for forks 43 from forklifts 44 on all four sides 45, 46, 47, 48, and (iii) dipping or spraying a tough coating on all surfaces, encapsulating foam edges and composite skins 131, 133.

With reference to FIGS. 4-8, an alternative embodiment of a pallet 100 will be described. The pallet 100 is made of the same material as the pallet 10 shown and described above with respect to FIGS. 1A-3, the subject matter of which is incorporated by reference herein, except the main differences being that instead of the pallet 10 including voids 30, 31, 40, 41 where the entire core is removed to accommodate the forks 43 from the forklift 43, the pallet 100 includes a plurality of hollow blocks 110 structurally bonded and/or bolted along a bottom surface 120 of the pallet 100. The pallet 100 includes Z-axis fiber-reinforced rectangular sandwich panel 12 shown and described with respect to FIGS. 1A-2B and 9. The sandwich panel 12 takes all the bending, and the pallet 100 does not have any material between the bottom of the blocks 110 and the horizontal surface supporting the pallet, which could be referenced as the ground. The blocks 110 are hollow to reduce weight. The blocks are preferably made from composite pultrusions and cut from these continuous profiles. They are designed to take high vertical compressive loads, with the wall thickness heavier on the vertical edges. FIG. 5B shows the blocks include vertical walls having a wall thickness W1 and horizontal walls having a wall thickness H1, and the wall thickness W1 of the vertical walls is greater than the wall thickness H1 of the horizontal walls. Alternately, the blocks could be fully molded in the correct shape, made from injection molded or other forming processes available in composite materials. The blocks can be attached with high-strength structural adhesive or fasteners, or both.

Figure 8:
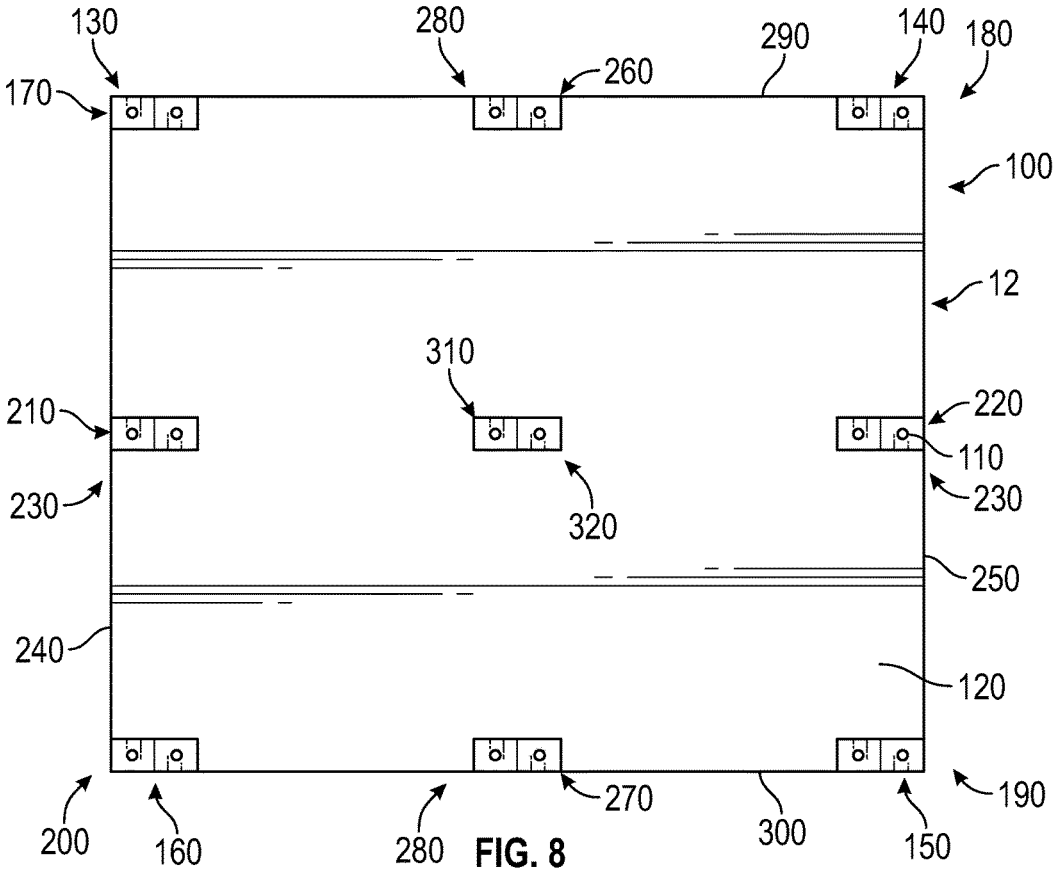
FIG. 8 is a bottom plan view of the pallet of FIG. 4.

As shown in FIG. 8, bottom surface 120 of the pallet 100 includes the following nine blocks connected thereto: corner blocks 130, 140, 150, 160 disposed at four corners 170, 180, 190, 200 of the panel 12, end blocks 210, 220 disposed at centers 230 of opposite longitudinal ends 240, 250, side blocks 260, 270 disposed at centers 280 of opposite lateral sides, 290, 300, and center block 310 disposed at a center 320 of the bottom surface 120 of the panel 12.

The forks 43 from the forklift 44 go underneath the pallet 100, along the bottom surface 120 and between the blocks 110, to lift the pallet 100. The bolted-on and/or bonded blocks 110 provide 10,000 lbs. of shear capacity. The pallet 100 passed ISO 8611-1:2012 bending test with 5500 lbs. loaded for 24 hours. The pallet 100 is dipped into or sprayed with a tough coating on all outer surfaces, encapsulating foam edges and composite skins 131, 133.

FIG. 9 is a cross-sectional view of an embodiment of a structural sandwich panel or part of the pallets 10, 100 shown and described with respect to FIGS. 1A-8. In the structural sandwich panel or part 12 of FIG. 9, 3D fibers 137 tie the core 135 to the skins 131, 133. Each structural sandwich panel or part includes first sandwich skin 131, second sandwich skin 133, interior foam core 135, and distinct groups of 3D Z-axis fibers 137 that extend from the first sandwich skin 131 to the second sandwich skin 133, linking the sandwich skins 131, 135 together.

There are literally billions of pallets produced each year, mostly of wood, and mostly being abandoned at "destination". This technology and process for a new composite pallet 10, 100 eliminates manufacturing labor and presents a very viable, rugged pallet for the logistics industry.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. A pallet, comprising:

a rectangular Z-axis fiber-reinforced composite sandwich panel including a bottom surface; and a plurality of blocks connect to the rectangular Z-axis fiber-reinforced composite sandwich panel along the bottom surface and nothing underneath the plurality of blocks, the plurality of blocks spaced along the bottom surface to accommodate forks of a forklift there between, wherein the plurality of blocks include vertical walls having a wall thickness and horizontal walls having a wall thickness, and the wall thickness of the vertical walls is greater than the wall thickness of the horizontal walls.

2. The pallet of claim 1, wherein the pallet includes an outer surface and a tough coating applied to outer surface of the pallet.

3. The pallet of claim 1, wherein the rectangular Z-axis fiber-reinforced composite sandwich panel includes a fiber composite material including a first sandwich skin, a second sandwich skin, an interior core, and distinct groups of 3D Z-axis fibers that extend from the first sandwich skin to the second sandwich skin, linking the sandwich skins together.

4. The pallet of claim 3, wherein the first sandwich skin, the second sandwich skin, and the 3D Z-axis fibers are a thermoset composite material.

5. The pallet of claim 3, wherein the first sandwich skin, the second sandwich skin, and the 3D Z-axis fibers are a thermoplastic composite material.

6. The pallet of claim 3, wherein the interior core is a thermoset foam.

7. The pallet of claim 3, wherein the interior core is a thermoplastic foam.

8. The pallet of claim 1, wherein the plurality of blocks are bolted-on to the rectangular Z-axis fiber-reinforced composite sandwich panel along the bottom surface.

9. The pallet of claim 1, wherein the plurality of blocks are structurally bonded on to the rectangular Z-axis fiber-reinforced composite sandwich panel along the bottom surface.

10. The pallet of claim 1, wherein the rectangular Z-axis fiber-reinforced composite sandwich panel includes four corners and the plurality of blocks include corner blocks disposed at four corners of the rectangular Z-axis fiber-reinforced composite sandwich panel.

11. The pallet of claim 10, wherein the rectangular Z-axis fiber-reinforced composite sandwich panel includes opposite longitudinal ends with a center and the plurality of blocks include end blocks disposed at the center of the opposite longitudinal ends of the rectangular Z-axis fiber-reinforced composite sandwich panel.

12. The pallet of claim 10, wherein the rectangular Z-axis fiber-reinforced composite sandwich panel includes opposite lateral sides with a center and the plurality of blocks include side blocks disposed at the center of the opposite lateral sides of the rectangular Z-axis fiber-reinforced composite sandwich panel.

13. The pallet of claim 10, wherein the rectangular Z-axis fiber-reinforced composite sandwich panel includes a center and the plurality of blocks include a center block disposed at the center of the rectangular Z-axis fiber-reinforced composite sandwich panel.

14. The pallet of claim 1, wherein the plurality of blocks are composite pultrusions.

15. The pallet of claim 1, wherein the plurality of blocks are injection molded.

16. The pallet of claim 1, further including at least one of structural adhesive and fasteners that connect the plurality of blocks along the bottom surface of the rectangular Z-axis fiber-reinforced composite sandwich panel.

17. The pallet of claim 1, wherein the plurality of blocks include opposite open ends facing a same direction.

18. A pallet, comprising:

a rectangular Z-axis fiber-reinforced composite sandwich panel including a bottom surface; and a plurality of hollow blocks connect to the rectangular Z-axis fiber-reinforced composite sandwich panel along the bottom surface and nothing underneath the plurality of blocks, the plurality of blocks spaced along the bottom surface to accommodate forks of a forklift there between the plurality of hollow rectangular blocks each including a longitudinal axis that is non-perpendicular with the bottom surface of the rectangular Z-axis fiber-reinforced composite sandwich panel.

19. The pallet of claim 18, wherein the plurality of blocks are composite pultrusions.

20. A pallet, comprising: a rectangular Z-axis fiber-reinforced composite sandwich panel including a bottom surface; and a plurality of hollow rectangular blocks connect to the rectangular Z-axis fiber-reinforced composite sandwich panel along the bottom surface and nothing underneath the plurality of blocks, the plurality of blocks spaced along the bottom surface to accommodate forks of a forklift there between, the plurality of hollow rectangular blocks each including four walls, one of said walls attached to the bottom surface of the rectangular Z-axis fiber-reinforced composite sandwich panel.

* * * * *